United States Patent [19]

Elsner et al.

[11] 3,990,215

[45] Nov. 9, 1976

[54] ROLL WRAPPING OR BANDING MACHINE

[75] Inventors: Bertram F. Elsner; Frank Elsner, Jr., both of Hanover, Pa.

[73] Assignee: Elsner Engineering Works, Inc., Hanover, Pa.

[22] Filed: Nov. 14, 1974

[21] Appl. No.: 523,883

[52] U.S. Cl. ..... 53/182 R; 53/198 R; 53/228; 53/389

[51] Int. Cl.[2] ..... B65B 9/02; B65B 51/30

[58] Field of Search ..... 53/182, 198 R, 228, 53/229, 230, 389, 373

[56] References Cited

UNITED STATES PATENTS

| | | | |
|---|---|---|---|
| 2,424,406 | 7/1947 | Marshall | 53/234 X |
| 2,977,730 | 4/1961 | Ardner | 53/389 X |
| 3,078,632 | 2/1963 | Forman | 53/228 X |
| 3,097,462 | 7/1963 | Langdon | 53/198 R X |
| 3,158,973 | 12/1964 | Monaghan | 53/182 X |
| 3,248,849 | 5/1966 | Hanson | 53/198 R |
| 3,355,857 | 12/1967 | Tobey | 53/182 |
| 3,469,368 | 9/1969 | Churchill et al. | 53/182 X |
| 3,488,912 | 1/1970 | Christian | 53/182 X |
| 3,490,194 | 1/1970 | Monaghan | 53/182 X |
| 3,523,402 | 8/1970 | West | 53/198 R |
| 3,564,810 | 2/1971 | Faletti | 53/198 R |
| 3,775,939 | 12/1973 | Elsner | 53/198 R |
| 3,792,561 | 2/1974 | Carnes | 53/182 X |

*Primary Examiner*—Travis S. McGehee
*Assistant Examiner*—J. Sipos
*Attorney, Agent, or Firm*—C. Hercus Just

[57] ABSTRACT

A machine to apply strips or webs of heat-sealable and/or heat shrinkable material around coiled rolls of sheet material to either band or wrap such rolls, or shrink such bands or wrapping web into close contiguous engagement with said rolls to prevent uncoiling of the same. The machine includes means to relax the tension on the strips or webs when the same are about to be heat sealed to encircle coiled rolls by means of anvil and heater bars which cooperate to engage said strips or web when encircling the rolls and heat-seal the same and simultaneously sever the encircling portions from the supply and also re-connect the severed portions by fusion to position the same across the path of the rolls through the machine for engagement by the rolls. Pusher means also push the coiled rolls into engagement with re-connected strips or web by means of guide mechanism for the pusher means which moves it horizontally. A removal conveyor also operates in association with a stationary member which supports the rolls while being encircled with said strips or web to remove the banded or wrapped rolls from the heat sealing means to carry them to additional heating means to heat-shrink the bands or wrapping webs around the coiled rolls.

7 Claims, 10 Drawing Figures

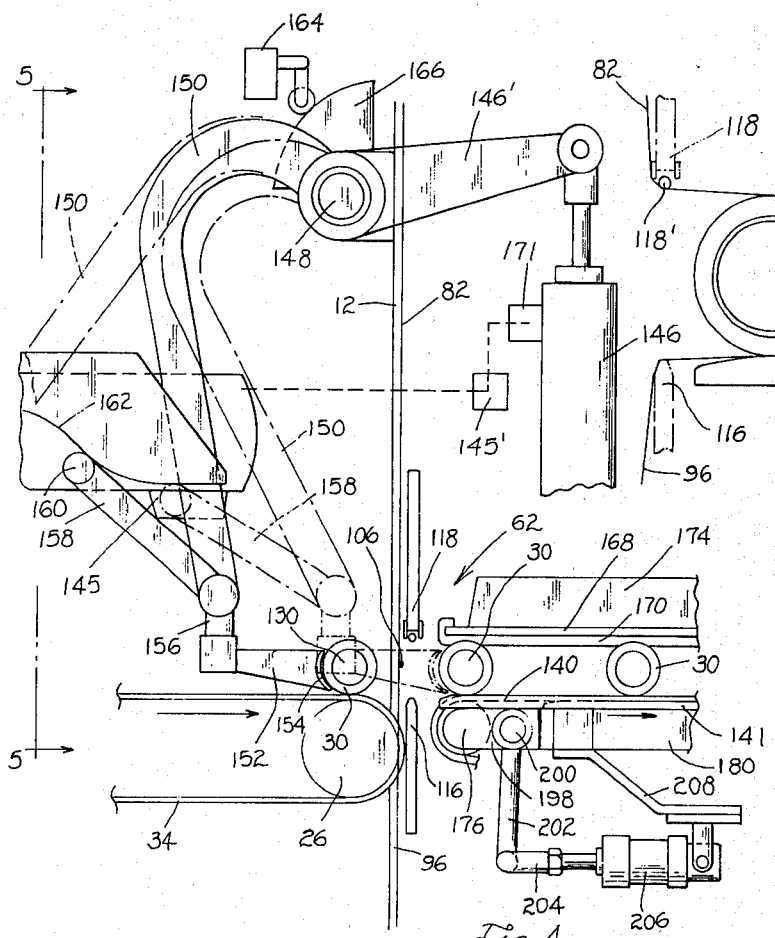
Fig. 4
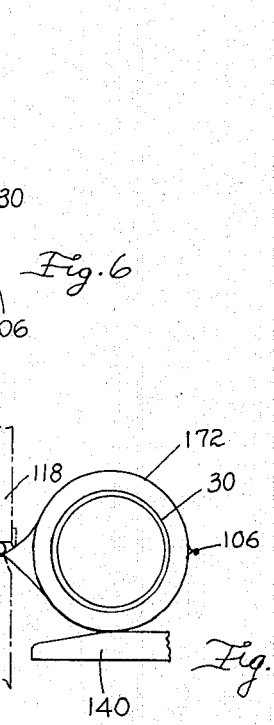
Fig. 6
Fig. 7
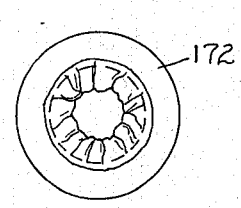
Fig. 10
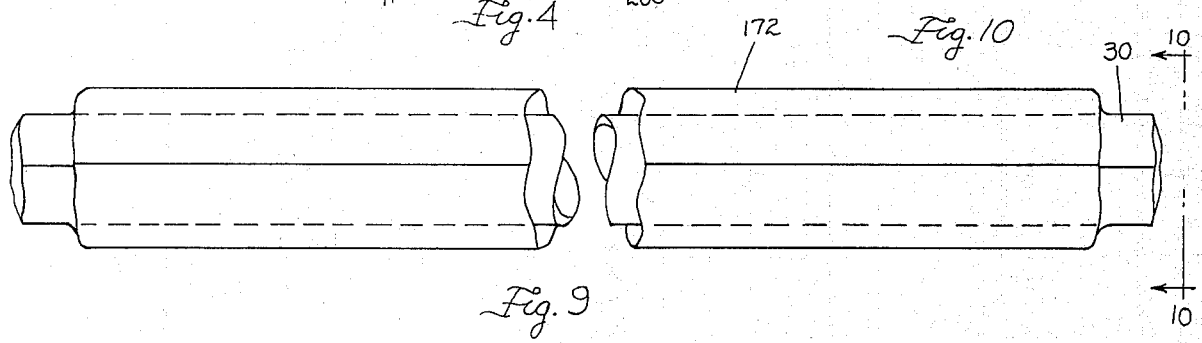
Fig. 9
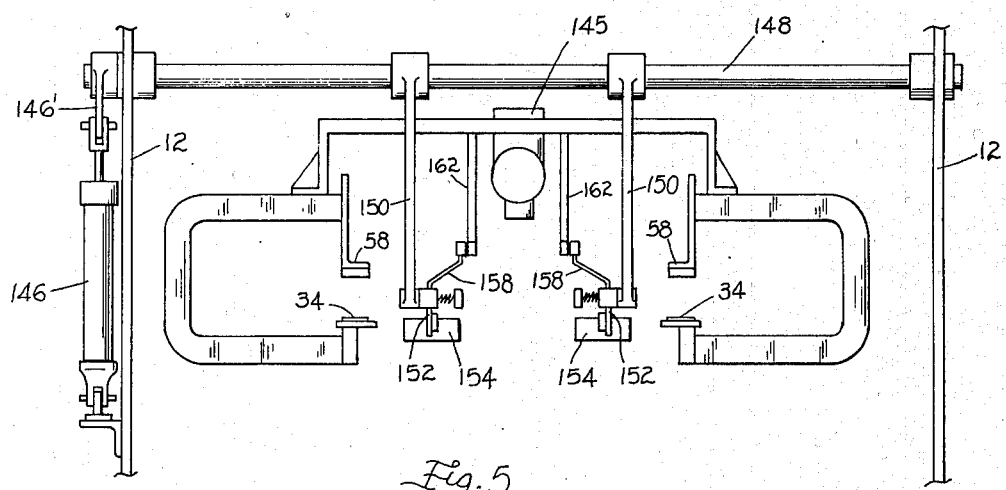
Fig. 5

ROLL WRAPPING OR BANDING MACHINE

CROSS-REFERENCE TO RELATED APPLICATION

The present application is directed to a machine embodying improvements over the machine comprising the subject matter of applicant's copending application Ser. No. 465,676, filed Apr. 30, 1974 now U.S. Pat No. 3,866,389 and comprising a Continuation-In-Part application of prior application Ser. No. 358,582, filed May 9, 1973, and now abandoned.

BACKGROUND OF THE INVENTION

The present invention primarily comprises improvements in the structure of applicant's previously developed roll wrapping machine comprising the subject matter of said aforementioned co-pending application Ser. No. 465,676 now U.S. Pat No. 3,866,389. The invention comprising the subject matter of said co-pending application primarily is directed to the forming of a loose wrapper heat-sealed longitudinally around a tightly coiled roll of sheet material and including means to shrink selected portions of said wrapper, which is formed of heat-shrinkable as well as heat-sealable plastic or synthetic resin material and thereby cause said selected portions of said wrapper to be in close contiguous engagement with said coiled roll of material and thereby maintain the same against uncoiling incident to the entire wrapper being shrunk into overall close contiguous engagement with the coiled roll. The improvements comprising the subject matter of the present application however have been found to be applicable not only to the machine comprising the subject matter of said co-pending application but also machines in which strips of heat-sealable and heat-shrinkable material may be extended around tightly coiled rolls of sheet material at longitudinally spaced locations thereon or, if desired, only a single band may be extended around such roll, if desired, and such bands are subsequently shrunk, by the application of heat, into close contiguous engagement with the coiled rolls of sheet material. Such a machine comprises the subject matter of applicant's prior U.S. Pat No. 3,775,939 dated Dec. 4, 1973. Accordingly, it is to be understood that the present invention is applicable to both banding as well as wrapping machines in which heat-sealable as well as heat-shrinkable materials are disposed around tightly coiled rolls of material such as gift wrapping material and the like.

As referred to in applicant's co-pending application Ser. No. 465,676, one of the continuing problems involved in handling rolls of coiled sheet material, whether wound around a core member or if they are coreless rolls, is to prevent the same from uncoiling until the rolls are suitably wrapped. To accomplish this, the industry has for a substantial period of time resorted to various means for securing such coiled rolls of material against uncoiling as, for example, by utilizing one or more dots of adhesive between the outer end of the material and the next adjoining convolution thereof, applying adhesive strips of different kind at one or more locations over said outermost end of the coiled sheet, as well as certain other means by which the means to restrain uncoiling of the rolls of material are utilized as a preliminary step and as separate or extra operations, to the wrapping of such coiled rolls, thereby adding to the overall expense of producing said roll for ultimate sale.

The machine comprising the subject matter of applicant's co-pending application Ser. No. 465,676 provides means by which tightly coiled rolls of sheet material are introduced to the machine by a rolling motion which rotates said rolls in the direction to maintain them coiled, until they reach a station where a web of wrapping material of heat-shrinkable as well as heat-sealable nature is applied somewhat loosely around the coiled roll and sealed longitudinally, after which the lossely wrapped rolls are subjected to heating means of limited width at longitudinally spaced locations along the wrapper to shrink limited areas thereof into close contiguous relationship with the coiled roll of sheet material therein and thus prevent uncoiling of the roll of material when the partially completed product is subjected to additional means to shrink the entire wrapper into close engagement with the coiled roll of material. Through operation of certain of said machines however, it now has been found that a number of improvements may be included therein and thus render the machine more versatile in operation as well as rendering the operations more efficient and in several respects providing more effective handling of the wrapping and/or banding material, details of which are set forth hereinafter.

SUMMARY OF THE INVENTION

It is one of the principal objects of the invention to provide a machine in which a first conveyor receives rolls of tightly coiled material and revolves the same in a direction to maintain the coil until they reach a heat-sealing station in which either strips of heat-sealable and/or heat-shrinkable material, or webs thereof which may preferably be slightly wider than the length of said coiled rolls, are disposed around the rolls and the encircling material is sealed by heat applied by co-operating anvil and heater bars which simultaneously also sever the supply of such encircling material from the encircling portion and also instantly re-connect, by fusion, the severed portions of the supply material incident to forming the encircling portion of the material around the coiled roll and thereby reconstituting a portion of the supply material which extends transversely, and preferably substantially vertically, across the path of movement of the rolls through the machine, one of said improvements comprising means by which tension which is applied to the transversely extending portions of strips or webs of said material is relaxed immediately prior to the material being heat-sealed in encircling manner around the coiled rolls, thereby insuring the formation of a highly satisfactory fused connection of the severed ends of the strips or web of material which are reconstituted so as to establish said transversely extending strips or web for engagement by the suceeding coiled roll of material.

It is another object of the invention to provide a second conveyor which extends from stationary plate means upon which the coiled rolls of material momentairly rest while said strips or web of heat-sealable material are extended around the coiled rolls and be heat-sealed in encircling manner thereon, said second conveyor comprising a pair of belts spaced apart transversely and the upper course thereof comprising a continuation of the path for said rolls to move through said machine, said stationary supporting plate having interruptions therein within which the receiving ends of said belts of said second conveyor project, and idler pullys around which said receiving ends of said belt conveyor extend being supported on a short frame movably mounted and having actuating means connected thereto for purposes of moving said receiving end of said belt conveyor from a position slightly below the level of said supporting plate to a position slightly above the same, whereby when said receiving end of the conveyor is elevated to the latter position, the coiled rolls of material which have been encircled with said strips or web of heat-shrinkable material then are actively engaged by said second conveyor and moved thereby away from said heat-sealing means and supporting plate. Under circumstances where the encircling material is also heat-shrinkable and it is desired to shrink the same into contiguous engagement with the coiled rolls, said second conveyor is associated with heating means by which said encircling material is shrunk into close engagement with the coiled roll.

One further improvement afforded by the present invention comprises pusher means which are mounted above the first conveyor of the machine which rotatably moves coiled rolls of sheet material from the entrance of the machine to the heat-sealing means and stationary suppporting plate, the rolls being spaced apart longitudinally of the path of movement suitable distances, whereby said pusher means may be projected into the path of movement of said rolls immediately prior to the same reaching said supporting plate for positively pushing the leading roll on said first conveyor onto said supporting plate, said pushing mechanism comprising pusher members pivotally connected to the outer ends of said arms and being guided by cam means in a manner to cause said pushing members to operate in a substantially horizontal plane coincident with the path of movement of said coiled rolls on said first conveyor, thereby improving the engagement of said coiled rolls of material by said pushing means as distinquished from the pushing mechanism illustrated and described in applicant's co-pending application referred to above.

It also is to be understood that there are various detailed improvements in structure in the above-described principal improvements afforded by the present invention and details of the same are set forth below and are illustrated in the accompanying drawings of the application.

BRIEF DESCRIPTION OF THE DRAWINGS

FIG. 4 is a fragmentary side elevation showing details of applicants' pusher mechanism, the pushing members being illustrated in several progressive positions respectively shown in full and broken lines, said view also illustrating details of the stationary supporting plate and receiving end of the second conveyor of the machine which represents a further improvement of the invention.

FIG. 5 is a fragmentary, foreshortened vertical elevation illustrating the mechanism shown in FIG. 4 as seen substantially along the line 5—5 thereof.

FIG. 6 is an exemplary, fragmentary side elevation showing a roll of coiled material in process of having a wrapper applied therearound, the anvil and heating bar being spaced in said view to permit passage of said coiled roll therebetween.

FIG. 7 is a view similar to FIG. 6 but showing said bars in sealing and severing engagement with each other following application of a strip or web of heat-sealable material around a coiled roll of said material.

FIG. 9 is an exemplary view of a foreshortened coiled roll of material having a wrapper applied thereto by the heater means shown in FIGS. 1 and 2 in which the end portions of the wrapper have been shrunk to prevent uncoiling of the coiled roll of material therein and axial shrinkage of the wrapper.

FIG. 10 is an end view of the roll shown in FIG. 9 as seen on the line 10—10 thereof.

DETAILED DESCRIPTION

Figure 1:
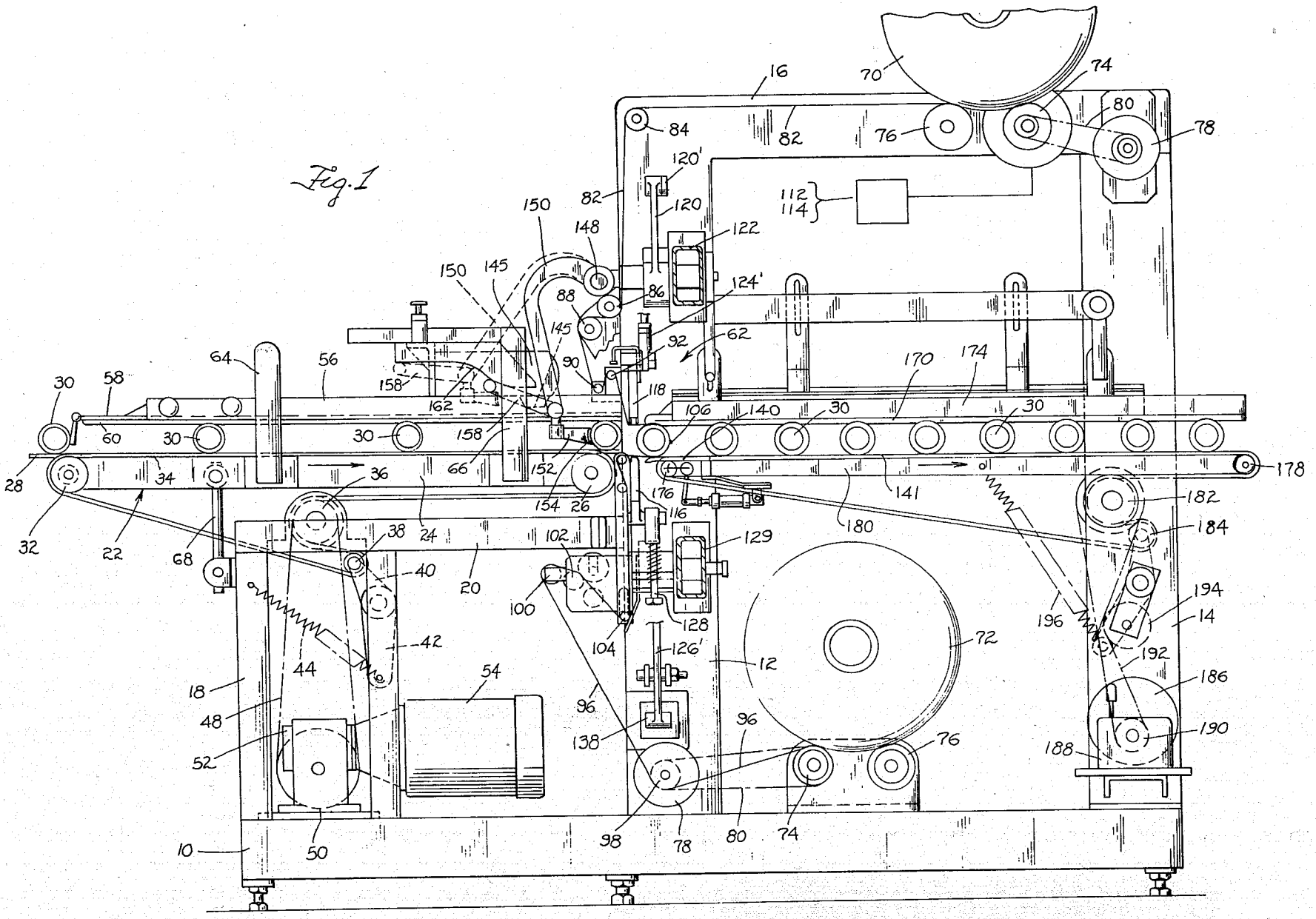
FIG. 1 is a side elevation of a machine embodying the principles of the present invention and illustrating the major improvements comprising the same over applicants' prior invention.
Figure 3:
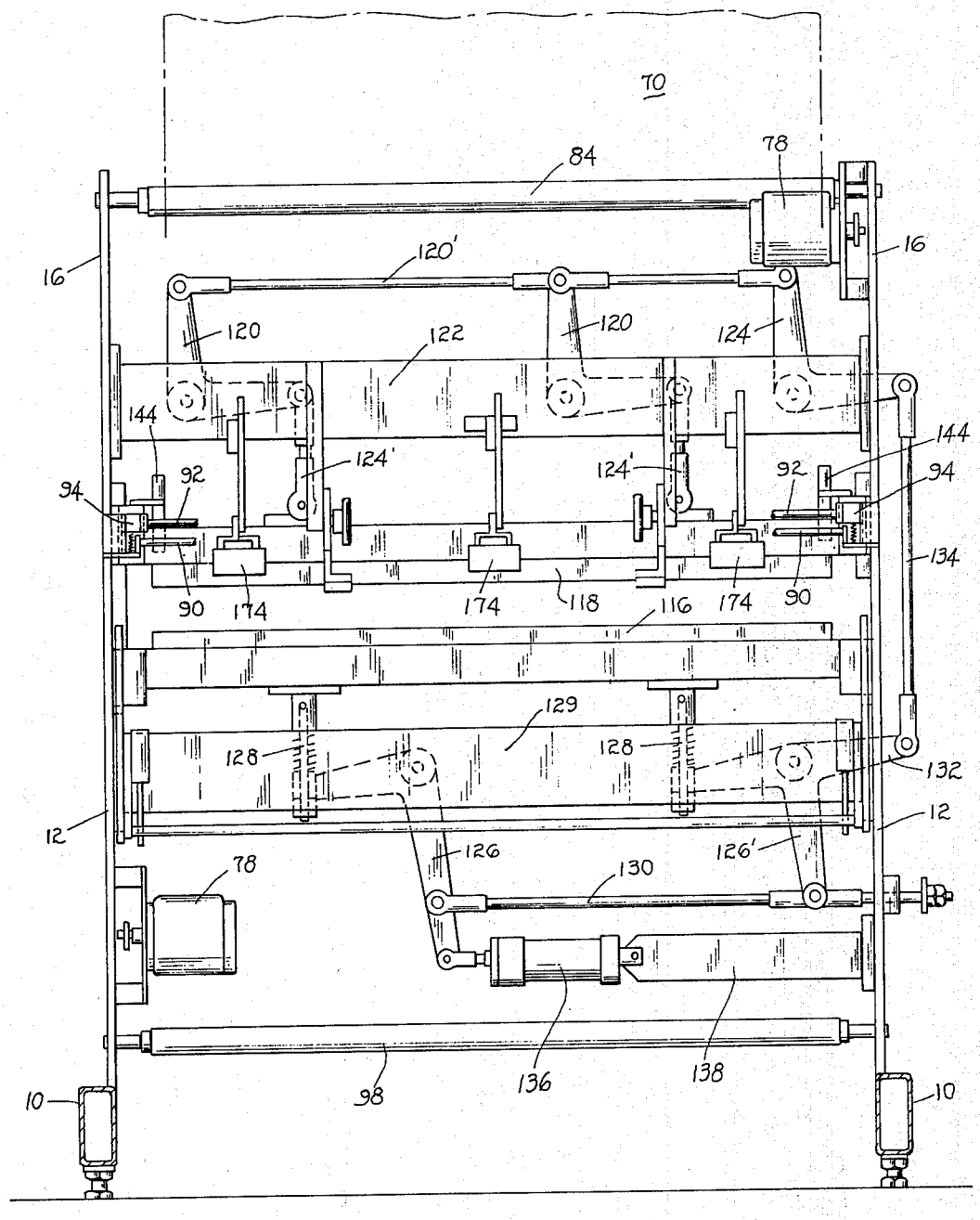
FIG. 3 is a vertical sectional view of the machine shown in FIGS. 1 and 2 as seen substantially midway thereof and illustrating actuating means for the anvil and heating bars.

Referring to FIGS. 1 and 3 in particular, the machine comprising the present invention is composed of a base frame 10 from which several pairs of upright plates 12 and 14 extend to substantially the same height, at opposite sides of the machine, said plates having horizontal frame plates 16 connected to the upper ends of opposite pairs of the plates 12 and 14, as shown in FIG. 1. Adjacent the inlet end of the machine, the frame also comprises additional shorter upright members 18, respectively at opposite sides of the machine for purposes of supporting additional horizontal side members 20 connected to the upper ends of the members 18 and to appropriate locations on the upright plates 12.

A first conveyor frame 22 extends from the inlet end of the machine, adjacent the left-hand end as viewed in FIG. 1, and extends horizontally inward substantially to the upright side plates 12. Said frame 22, as viewed in FIG. 2, has a width substantially less than that of the entire machine and comprises a pair of longitudinally extending frame members 24, best shown in FIG. 2, the inner end of said frame 22 supporting a pair of similar idler sheaves 26 and the inlet end of said frame 22 having a transverse horizontal plate 28 extending between the frame members 24 and adapted to receive coiled rolls of sheet material 30 from any suitable means such as a re-wind machine of conventional type, or fed by hand.

The forward ends of the frame members 24 also support additional idler guide sheaves 32 which are similar in size to the sheaves 26. Endless flexible feed belts 34 move along the upper surfaces of the frame members 24 and around the sheaves 26 and 32. Referring to FIG. 1, it will be seen that each belt also extends around a drive sheave 36 and a tensioning idler sheave 38 mounted on the outer end of a pivoted arm 40 which extends in opposition to another arm 42 to which one end of a tensioning spring 44 is connected, the opposite end being connected to the upright frame member 18 as shown in FIG. 1.

Figure 2:
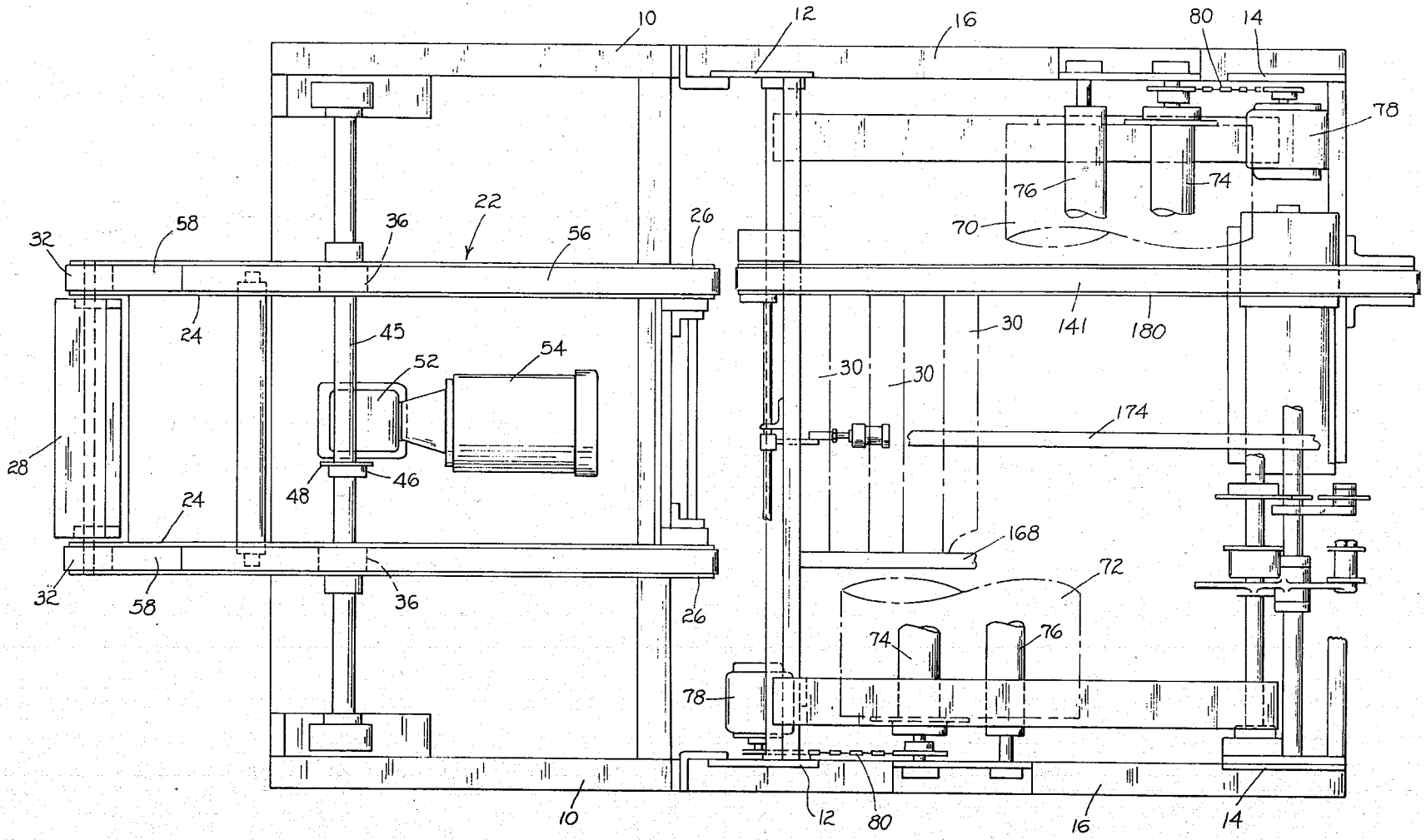
FIG. 2 is a partially fragmentary plan view of the machine shown in FIG. 1 with most of the upper portion of the mechanism removed to illustrate details particularly of the first and second conveyor means included in said machine.

As best shown in FIG. 2, the drive sheaves 36 are connected to a drive shaft 45 upon which a sheave 46 is connected and is driven by a suitable belt or sprocket chain 48 which extends around sheave 46 and also around drive sheave 50, see FIG. 1. The drive sheave 50 is connected to an output shaft of gear reduction unit 52 which is driven by an electric motor 54 mounted in the lower portion of the frame 10.

Overhead longitudinal frame members 56 are mounted parallel to and above the upper courses of the feed belts 34 comprising inlet conveyor means. The frame members 56 have longitudinally extending stationary plates 58 supported thereby in parallel relationship to the upper courses of the feed belts 34, the lower surface of the plates 58 preferably having strips of compressible material 60 extending therealong as best shown in FIG. 1, the same comprising sponge rubber or similar material. The purpose of the strips 60 is to afford frictional engagement by the coiled rolls of material 30 as the same are moved by the upper courses of the belts 34 which travel in the direction of the arrow shown in FIG. 1 toward the unit 62 located adjacent the inner end of the upper courses of belts 34, as best shown in FIGS. 1 and 4, which is for purposes of applying a wrapper or a web of heat-sealable and/or heat-shrinkable material, or types thereof to form encircling bands as described in detail hereinafter.

The overhead frame members 56 preferably are vertically adjustable a limited extent in order to accommodate rolls 30 of a limited range of different diameters. Suitable conventional adjustable means, details of which are not shown, connect said frame members 56 and the elements carried thereby with respect to upright frame members 64 and 66 which are shown in exemplary manner in FIG. 1 and extend upward from the longitudinal frame members 24 which support the feed belts 34. Vertical adjustment of the outer end of said assembled frame means and the belts 34 is made possible by appropriate adjustment means 68 of a suitable nature, shown in FIG. 1, and thereby adapt the entrance end of the first conveyor frame 22 to the discharge means of a re-wind machine, for example, not shown.

WRAPPER OR BAND APPLYING UNIT

The wrapper or band applying unit 62 receives a web or a plurality of strips of heat-sealable and/or heat-shrinkageable synthetic resin material of suitable type, of which a number of different commercial kinds are available, from supply rolls 70 and 72 thereof respectively mounted in the upper and lower portions of the frame 10. One roll each of web material may be used or if strip material are used, to form bands, a plurality of coiled strips thereof may be used and mounted suitably in the upper and lower parts of the machine frame. Commercial rolls of web material, especially if of the order of 30 inches or 36 inches wide, for example, may be as much as 8 or 10 inches in diameter. Rolls of this size are quite heavy and may be of as mush as 50 or 60 pounds or more in weight. Accordingly, the present invention specifically illustrates such coiled webs and contemplates that said rolls will be uncoiled in power means. However, coiled strips of material may be supported by means such as shown in applicants' prior U.S. Pat. No. 3,775,939.

The rolls 70 and 72 of said web material respectively rest upon pairs of rollers 74 and 76, each of the rollers 74 being power driven by appropriate motors 78 through the medium of a sprocket chain 80. Said motors operate at appropriate speed. Rollers 74 are provided with suitable flanges to position the supply rolls 70 and 72 thereon axially and the rollers 76 are idlers. Said supply rolls are driven intermittently by control means, details of which are described hereinafter.

The upper heat-shrinkable wrapper sheeting or banding strips 82 feed over idler rolls 84 in the upper portion of the frame of the machine, the web or strips then extending around idler rolls 86 and 88, from which the same extend to web or strip contracting means in the form of a plurality of rods 90 and 92 which extend between the opposite frame members 12. Rod 92 normally is higher than rod 90 to form a contracted portion in the upper web or strip of film material 82 and is supported in vertically movable blocks 94 which normally are spring-pressed upwardly as shown in FIG. 3. From rod 92, the web or strips 82 extend downward for connection to lower web or strips 96 which is paid off of coils 72 of web or strips thereof.

Figure 8:
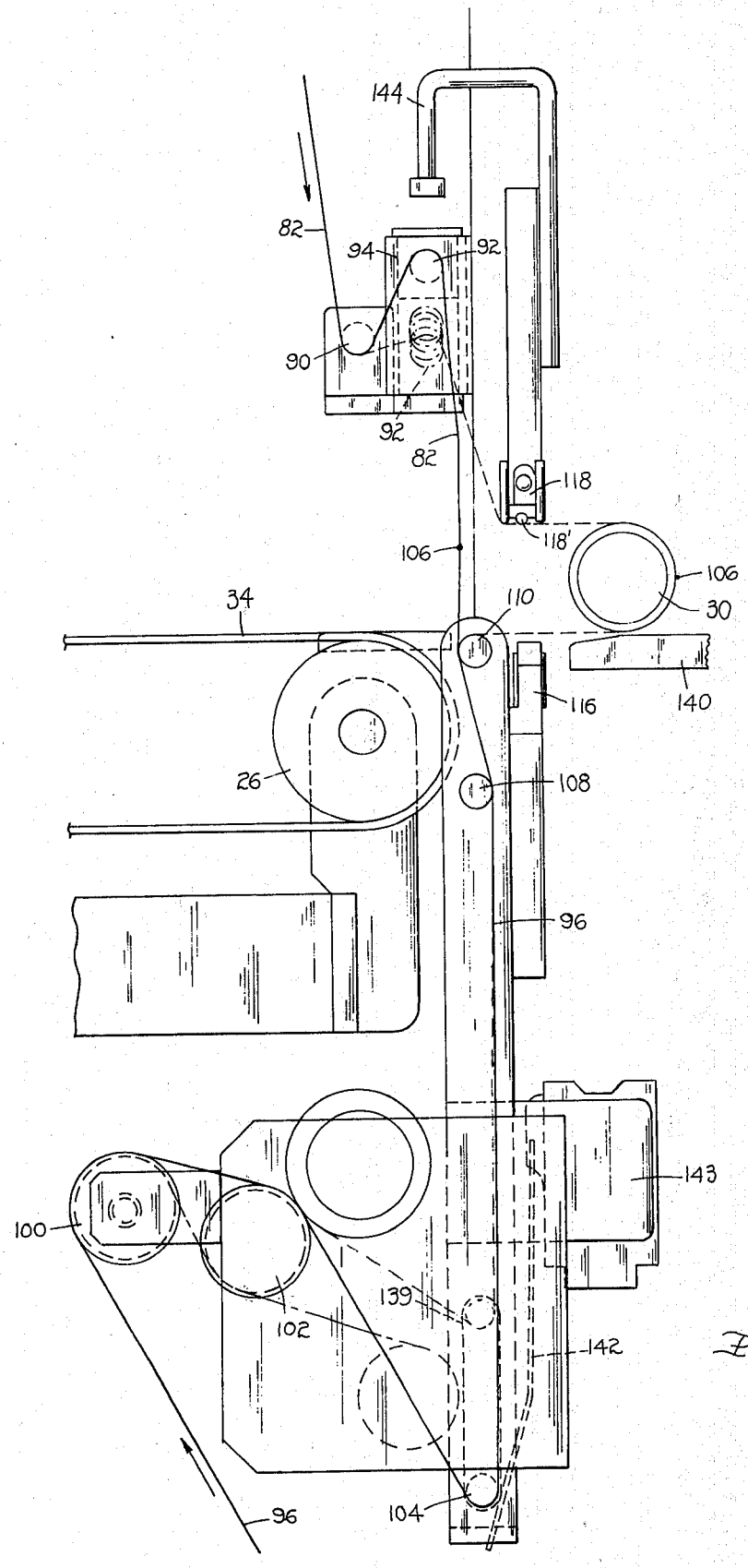
FIG. 8 is an enlarged, fragmentary vertical elevation illustrating the central portion of the machine shown in FIG. 1 and exemplifying the operating principles of improvements of the present invention which comprises releasing the tension upon the transversely extending portion of the strips or web of heat-sealable material incident to the same being extended around a coiled roll of material in encircling manner.

The lower web of wrapper sheeting or banding strips 96 extend over idler roll 98 and then up to and around guide rollers 100 and 102 and down to and around vertically movable dancer bar 104. From bar 104 to form a contracted portion in the lower web or strip of film material 96, the web or strips 96 extend upwardly and are connected to upper web or strips 82 to which they are connected by a fused joint 106 to form a continuous web or plurality of strips that extend across the path of the oncoming coiled rolls 30 as shown in FIGS. 1, 4, and 8. Web or strips 96 also extend past additional transverse guide bars 108 and 110 shown best in FIG. 8.

Intermittent driving of the supply roll 70 is effected by timer 112 if the material is plain web or strips without pattern. If the material is a web with a pattern on it such as art work, instructions or other text material, the web should be advanced in increments equal to each pattern panel. To accomplish this, the control means for the upper electric motor 78 is a circuit in which a switch controlled by a photoelectric cell 114 is utilized to be responsive to the pattern panels and thereby cause stepwise movement of said web 70.

The heating-sealing strip or web wrapper-applying unit 62 is provided with an upwardly movable, horizontally extending anvil bar 116 and a downwardly movable heater bar 118 which are parallel to each other and are disposed commonly within a substantially vertical plane, as shown in FIGS. 1, 4, 6 and 7 which is transverse to the path of rolls 30 through the machine. Said bars actually are composite and respectively are carried by transversely extending supporting member to which said bars are affixed. The opposite ends of the bars 116 and 118 are disposed within appropriate guides on the upright frame plates 12 at opposite sides of the machine. Said bars preferably are moved from vertically spaced positions thereof to and from engagement of the faces of said bars into substantial abutment with each other, except for the portions of the webs of wrapper sheeting or strips of banding material which are disposed in over-lapping relationship with respect to each other between said abutting faces of the bars 116 and 118, as shown in FIG. 7, for example.

Bar 118 has an electrical resistance heating wire 118' extending therealong which is energized substantially instanteously by suitable control means, not shown, which when the bars are in substantially abutting relationship, as shown in FIG. 7, operates to supply current to the wire in suitable value to substantially instanteously effect severing of the overlying webs or strips 82 and 96, sealing by fusion the edges of the portions of the thermo-plastic heat-sealable webs or strips 96 which have been severed by the heating wire 118 so as to provide a loose wrapper or one or more encircling bands around the coiled roll 30, and also simultaneously unite by fusion the severed ends of the webs or bands 82 and 96 extending from the supply rolls so as to re-connect and thus reconstitute the aforementioned substantially continuous web or strips of theremo-plastic wrapper sheeting or strips to extend preferably transversely across the path of the oncoming coiled rolls 30 for engagement by said rolls.

Movement of the bars 116 and 118 in opposite directions with respect to each other for purposes of carrying the bars to and from wrapper or strip-sealing engagement is effected by commonly operated means comprising a pair of bell cranks 120 which are pivotally supported by an upper cross-frame member 122, as shown in FIG. 3, the upright portions thereof being connected by a horizontal link 120', the righthand end of which, as shown in FIG. 3, being connected to the upper end of another bell crank 124 and a plurality of vertical links 124' extending between and connecting the horizontal arms of bell cranks 120 with the heater bar 118.

The anvil bar 116 is supported and operated by a bell crank 126 and a T-crank 126', similarly extending horizontal arms of which are connected to vertical rods 128 which extend downward from tne anvil bar 116 and include compression springs shown in FIG. 3 around rods 128 to provide yieldability between the engaging faces of the anvil and heater bars 116 and 118.

The pivots of the bell crank 126 and T-crank 126' are supported by another horizontal cross-frame member 129 and the downwardly extending legs of said cranks are connected by a horizontal rod 130. The opposite horizontal leg 132 of T-crank 126' extends outwardly beyond one side of the machine and is connected to a vertical link 134, the upper end of which is connected to the outer ene of the horizontal leg of bell crank 124 as clearly shown in FIG. 3.

The lower end of bell crank 126 is also connected to the outer end of a piston rod projecting from one end of a fluid-operated cylinder 136, the opposite end being connected to a horizontal supporting arm 138, which is connected to one of the upright frame plates 12 as shown in FIG. 3. From said structure, it will be seen that when the piston in the cylinder 136 is operated in opposite directions, the anvil and heater bars 116 and 118 will be moved toward and from each other simultaneously and engagement of said bars will be of a cushion nature, due to the springs which surround the vertical rods 128.

The upper web or strips 82 which are connected to the lower web or strips 96 by the fused joint 106 extend substantially perpendicularly and intersect the path of movement of the coiled rolls 30 from the delivery end of feet belts 34 which comprise the first conveyor of the machine. Said continuous webs or strips are maintained under a predetermined amount of pressure by the manner in which the upper web or strips 82 extend around the rolls 86 and 88 as well as the manner in which the lower webs or strips 96 extend around rolls 100, 102, and dancer bar 104 which is movable is limited amount within vertical slots 139 which are best shown in FIG. 8. The dancer bar 104 has a limited amount of weight which, by means of gravity, is transmitted to the connected web or strips 82, 96 and, in addition, the feed rate of said upper and lower webs or strips is such that the same are combined with the gravity effect of dancer bar 104 to produce the desired amount of tension on the connected webs or strips 82, 96.

By means to be described hereinafter, as each foremost coiled roll of material 30 reaches the discharge end of feed belts 34 of said first conveyor, it is forcably transferred by pusher means from the discharge end of said first conveyor onto a substantially horizontal, transversely extending support member 140 which is coincident with the receiving end of a second conveyor 141 as shown in FIG. 1 and also in FIGS. 4 and 8. When this occurs, said foremost coiled roll 30 pushes against the transverse portion of said connected web or strips 82, 96 and thereby extends a substantial portion of the same around said roll 30 for about 180° for the circumference of the roll 30, as illustrated in FIG. 6. When in this position, it also will be seen that the roll 30 is past the vertical plane within which the anvil and heater bars 116 and 118 are disposed in order to permit said bars to move toward each other and effect sealing of the web or strip by fusion provided by the electrical resistance wire 118' and simultaneously sever the encircling portions of said web or strips which surround the roll 30 from the remaining portions of the web or strips 82, 96 and also simultaneously reconnect the severed portions of said web or strips and thereby reconstitute the transversely extending portion of the connected webs or strips 82 and 96 and dispose the same in the position illustrated in FIG. 4. Such movement of the anvil and heater bars 116 and 118 toward each other to the position thereof shown in FIG. 7 normally places further tension upon the connected webs or strips 82, 96. This hs been found to be undesirable and the present invention provides the following means to release that tension incident to the bars 116 and 118 moving toward each other, as follows.

When the oncoming coiled roll 30 initially engages the vertically extending transverse portion of the connected web or strips 82, 96, the portion thereof between the rods 92 and 110 will be extended toward the right as viewed in FIG. 8 and this will cause dancer rod 104 to rise upward and thereby commence to release the tension upon said connected web or strips. As the dancer rod 104 moves upwardly, it disengages switch-operating leaf 142 which actuates miroswitch 143 which is connected in the circuit of the lower motor 78 which drives the feed rolls of supply web or strips 72 and causes the same to commence feeding movement of said web or strips. Meanwhile, the anvil and heater bars 116 and 118 are moving toward each other which also tends to increase the tension upon the connected web or strips 82, 96 but as this occurs, it will be seen from FIGS. 3 and particularly FIG. 8 that the opposite ends of the heater bar 118 support brackets 144 which terminate in pressure feet that engage the vertically movable blocks 94 which support the rod 92 around which an upwardly extending portion of web or strips 82 extend as shown in full lines in FIG. 8. The blocks 94 normally are maintained in the uppermost position thereof by means of springs shown in FIG. 3 and the pressure feet on the brackets 144 move the blocks 94 and the rod 92 downwardly against the action of said springs to dispose the rod 92 at the lower dotted line position thereof shown in FIG. 8 and thereby, in conjunction with the feeding movement of the lower supply coil 72, release the tension upon the connected webs or strips 82, 96 which by now surround the coiled roll 30 substantially in the manner illustrated in FIG. 7 In this position, the sealing of the abutting portions of the webs or strips occurs, together with the simultaneous severing of the surrounding portions thereof on the roll from the supply portions of said web or strips and also simultaneously fuse the severed ends together to form another joint 106. By releasing the tension upon the web or bands by decreasing the contracted portions thereof which extend around the various guide rods, particularly at the time the severed ends are fused together permits the foolproof formation of an effective fused connection which is superior to any which occurs if the web or strips are under tension at the time such fusion to reconstitute the same occurs and constitutes a marked improvement of this invention.

ROLL INSERTING MEANS

The coiled rolls of sheet material 30 preferably are rotatably moved at constant speed, in spaced relationship to each other by means of the feed belts 34, which comprise the first conveyor, rotate the rolls relative to the strips of compressible material 60 in a direction to prevent unwinding of the material on said rolls. As the leading roll 30 approaches the united web 82, 96 of wrapper sheeting or banding strips, said roll passes beneath the scanning ray of a photoelectric unit 145 shown in FIGS. 1 and 4, the ray being emitted from means projecting from the lower surfaces thereof toward said rolls as they pass beneath the same. When said ray is intercepted by the leading roll 30, a control relay 145', which is in circuit with cylinder unit 146 moves crank arm 146' and shaft 148 counterclockwise. If desired, a timing device may be substituted for the photo-electric unit 145 and suitably connected in the operating cycle of the machine by known means.

Said shaft extends between bearings supported by the vertical frame plates 12 as shown in FIG. 5. Hubs on the upper ends of a pair of pusher arms 150 are connected to shaft 148 and said arms extend downward therefrom and the lower ends are pivotally connected to pusher members 152 which have arcuate faces 154 on the forward ends thereof which engage the coiled rolls 30. Normally, the arms are disposed in the uppermost phantom position thereof shown in FIG. 4, and in which the pusher members 154 are disposed above the space between the stationary plates 58 and conveyor feed belts 34, as shown in phantom in FIG. 1.

The pusher members 152 have an offset portion 156 which is connected to one end of a short shaft which extends through a bearing in the lower end of each arm 150. The other end of said shaft is fixed to a projecting arm 158 having an anti-friction roller 160 on the outer end which engages the surface of a positioning cam 162. A pair of said cams are provided respectively for each arm 158 and its roller, see FIG. 5.

The function of the pusher arms 150 is to move from the fully retracted position thereof, shown in phantom in FIG. 1, counter-clockwise to move the pusher member 152 on the lower ends thereof down into the path of movement of the rolls 30 so as to engage the trailing surface of the leading roll 30 on belts 34, as shown in full lines of the arm 150 in FIG. 4 while pusher members 152 are moving horizontally along a substantially straight path, and push said roll from the discharge end of said conveyor feed belts 34 onto the aforementioned stationary support plate 140, which is best shown in FIGS. 1, 4, 6 and 7. The arms 150 quickly return to the retracted position referred to above immediately after such pushing has been completed.

The substantially horizontal movement of pusher members 152 has been found to afford in improvement in the manner in which the rolls 30 are engaged and offers less disturbance than its engagement thereof by the means of applicants' co-pending application.

Intermediately of the pushing strokes of the arms 150, a jaw-opening limit switch 164 is closed by means of a cam 166 which is fixed to shaft 148. Said switch operates a solenoid, not shown, which controls a valve that directs operating fluid to the anvil and heater bar-operating cylinder 136, shown in FIG. 3. In FIG. 4, the cranks and linkage operated by the cylinder are not shown in their entirety for purposes of simplicity. The cylinder 136, under such circumstances, is moved in a direction to extend the jaws to open position, such as shown in FIGS. 1 and 4.

The pusher cylinder 146 continues to move the leading roll 30 which results in passing the roll between the spaced bars 116 and 118 and onto the stationary support plate 140 shown in FIGS. 4, 6 and 7. Said roll rests thereon for a brief interval of time and is held upon the support 140 by one end of each of a pair of similar horizontal, transversely spaced stationary plates 168, the under surfaces of which are lined with strips of compressible material 170. Thus, the roll 30, when resting upon the support plate 140, is effectively maintained in stationary condition for application of a heat-sealed wrapper sleeve or one or more encircling bands 172 therearound, shown in FIGS. 7, 9 and 10, of the wrapper sheeting or strips 82 and 96.

As the leading roll 30 enters the wrapper or band applying unit 62, it first intersects the vertically extending, reconstituted web or strips 82, 96 and pushes the same with it, said web or strips being paid off from the supply webs or strips are intermittently driven as described above, and pass around the idler rolls 86 and 88, until the roll comes to rest upon the stationary support 140. When this occurs, the pusher arms 150 will have moved to their fullest extent toward the wrapper-applying unit 62 and another switch 171, see FIG. 4 adjacent cylinder 146, is closed to de-energize the control relay 145'. This, in turn, de-energizes the solenoid, not shown, which controls the delivery of fluid to the pusher arm cylinder 146 and actuates it in a direction to return the pusher arms 150 quickly to the starting position thereof, so that they are ready for the next stroke when called upon for movement.

Approximately midway of the return stroke of the pusher arm cylinder 146, the switch 164 is released and this causes the first-mentioned solenoid valve referred to above, not shown, to become de-energized and thus cause the bars 116 and 118 to close, thereby bringing the webs of wrapper sheeting or strips 82, 96 which extend around the faces of said bars into abutment with each other as shown in FIG. 7, whereupon the heating wire 118' on bar 118 is instantly engergized to momentarily effect the severing of the webs or strips, axially sealing the edges of the web to strip sections which surround the roll 30, and simultaneously re-connecting and thus reconstituting the other edges of the webs 82 and 96 by fusion so as to form said continuous web or strip 82, 96 which has a portion extending transversely across the path of movement of the rolls 30.

At this stage, it is pointed out that the axial wrapper or bands which are sealed around the entire length of roll 30 or the bands at spaced locations thereon can be of a relatively loose naure and incapable of substantially preventing uncoiling of the sheet material which is tightly coiled upon a core, or is coreless, as it moves along the feed belts 34 and also as it is held stationarily upon the support plate 140. Therefore, in accordance with the present invention, when the web or strips of material 82 and 96 are of heat shrinkable as well as heat-fusible material, the applied wrapper 172, if loose on roll 30 as shown in FIG. 9, is subjected to longitudinally extending, preferably electrically energized, heating members 172, one or more of which are disposed in transversely spaced relationship to each other with respect to the discharge conveyor belts of the second conveyor 141 which extend around suitable guide sheaves 176 and 178 at opposite ends of the belt-supporting frame 180. Said belts also extending around driving sheaves 182 and tightening sheaves 184 as shown in FIG. 1.

In FIG. 3, it will be seen that three heating members 174 are illustrated at locations spaced longitudinally along and above the rolls 30 as they are moved by belts 141. If desired, however, only a single heater may be used, midway between the ends of rolls 30, as shown in FIG. 2. Further, as shown in exemplary manner in FIG. 9, the heating members 174 respectively may be mounted above the ends of rolls 30 to heat the outer ends of loose web wrapper 172, which initially project beyond the opposite ends of rolls 30, and not only prevent uncoiling of the rolls 30 but also prevent axial shrinkage of the ends of the wrapper 172 inwardly beyond the ends of the rollers 30.

The driving sheaves 182 for belts 141 are driven by an electric motor 186 which is connected to a gear reduction unit 188 having a driving sheave 190 around which a drive belt or sprocket chain 192 extends, said belt being maintained tight by a tightening roll 194 on lever means which are maintained in tightening direction by spring means 196.

The discharge conveyor belts 141 are driven in the direction of the arrow shown in FIG. 1 to rotate the rolls 30 in a direction to continue to maintain the sheet material in coiled condition thereon, even through the same are enclosed loosely within the wrapper 172.

Another improvement afforded by the present invention over the structure comprising the subject matter of applicants' aforementioned co-pending application, Ser. No. 465,676, comprises the manner in which wrapped or banded rolls 30, while on stationary support members 140, are engaged by the belts 141 of the second conveyor to move said rolls along the path thereof past heaters 174 when such bands or wrappers on the rolls are to be heat-shrunk. The improved structure is shown in FIG. 1 but is better illustrated in FIG. 4 in larger scale, as follows.

The receiving end of the second conveyor belts 141 is provided with a short sub-frame 198 which is pivotally supported by shaft 200 which extends between supporting frame membrs 180. The sub-frame 198 supports the sheaves 176 around which the forward ends of belts 141 extend. An arm 202 is connected at one end to shaft 200 and the other end is connected to the outer end of the piston rod 204 of fluid-operated cylinder unit 206 which is supported by a bracket arm 208 fixed to supporting frame 180. Support member 140 is transversely interrupted intermediately of its ends to accommodate the forward portions of conveyor belts 141 and permit said forward portions to be projected upwardly to a level slightly above the supporting surface of support member 140, or be moved by operation of cylinder unit 206 to a level slightly below said supporting surface of member 140.

During the brief interval of time when the rolls of material 30 are resting upon members 140 while a wrapper or one or more bands 172 being applied around rolls 30 in sucession as delivered to member 140 by the pusher mechanism of arms 150, the forward ends of conveyor belts 141 will be in the lower position thereof, slightly below the supporting surface of the member 140. The belts 141 preferably are continuously driven in a direction to move wrapped or banded rolls 30, by rotation thereof in a direction to prevent the coiled material thereon from uncoiling, toward the discharge end of the second conveyor beyond the ends of heaters 174.

Thus, rolls 30 will be held stationarily on member 140 while being wrapped by a web or banded by strips of material 82, 96. Immediately upon the completion of such wrapping or banding of the rolls 30, such as when the bars 116 and 118 of the heat-sealing means commence to separate, cylinder unit 206 is energized in a direction to raise the forward end of belts 141 above the level of member 140 and thereto start rotation of the roll 30 on member 140 away therefrom with the wrapper or bands surrounding said roll, thus clearing member 140 for reception of the next succeeding roll 30 which is to be wrapped or banded.

By the use of such improved roll transfer mechanism described above, there is no contact between successive rolls being wrapped or banded incident to an oncoming roll 30 being required to push the preceding wrapped or banded roll from the stationary support member 140 as in applicants' aforementioned co-pending application. This is advantageous especially when such wrappers or bands are applied in relatively loose condition and are a heat-shrinkable nature and are to be heat-shrunk by heaters 174.

The cylinder unit 206 is connected by suitable fluid circuitry, not shown, to and from a supply source and said circuitry also including valve means, not shown, preferably of the solenoid type which is actuated by switch 171, for example, through the use of a relay or other suitable means to actuate the unit 206 in desired sequence with the operation of pusher arms 150 and the heat-sealing bars 116 and 118.

Although the foregoing description of the present invention has referred to the machine especially being adapted to band or wrap coiled rolls 30 which are initially unrestrained against uncoiling, it is to be understood that the machine will operate equally well for wrapping or banding purposes of rolls in which the outer ends are secured against uncoiling, such as by the use of short lengths of tape, glue dots, bands, or otherwise.

From the foregoing, it will be seen that the present invention provides improvements in a machine for direct wrapping or banding of a coiled roll while preventing uncoiling of the roll, whereby the cost of producing tightly wrapped rolls of sheet material is minimized over procedures currently used by other machines.

While the invention has been described and illustrated in its preferred embodiments, it should be understood that the invention is not to be limited to the precise details herein illustrated and described since the same may be carried out in other ways falling within the true spirit and scope of the invention as illustrated and described.

We claim:

1. A machine for encircling coiled rolls of sheet material with enlongated heat-sealable film material provided in supply rolls, said machine comprising in combination, an elongated frame having at one end receiving means to introduce tightly coiled rolls of sheet material, as delivered from a rewinding machine, and discharge means at the opposite end of said frame, means in said frame defining a path for said coiled rolls including conveyor means operable at one end to receive and move said coiled rolls along said path in spaced relationship and in a manner to maintain them tightly coiled, means on said frame to support a plurality of supply rolls of heat-sealable film material with the outer ends thereof fused together to provide continuous film material; support and guide means mounted on said frame to position a portion of said continuous film material transversely to said path comprising a pair of transverse guide bars with one normally higher than the other and around which said film material extends from one of said supply rolls downwardly and around the lower of said bars and then upwardly around the higher of said bars to form a contracted portion in said continuous film material and said material then extending downward from said higher of said bars to form a transverse portion of said continuous film of material which extends across the path of movement of said coiled rolls of material, means operable upon said heat-sealable film material to maintain said transverse portion of the same under predetermined tension, means to move said coiled rolls sequentially against said transverse portion of said continuous film material and thereby partially extend the same around each roll; heat-sealing mechanism supported by said frame and comprising substantially parallel and horizontal anvil and heater bars mounted in vertical alignment with one above the other adjacent said continuous film material, means operable to move at least one of said bars vertically toward the other and engage said transverse portion of said continuous film material which is partially extended around a coiled roll of material to seal opposed portions thereof together to form heat-sealed encircling film material around said coiled rolls and simultaneously sever said transverse portions of said film material from said encircling portions thereof and reunite the severed ends of said film material to form united transverse portions thereof; and means carried by the uppermost of said vertically aligned anvil and heater bars and during vertical movement thereof engaging the higher of said pair of transverse guide bars to release said tension upon said film material at the time said heat-sealing of said opposed portions thereof and the reuniting of said severed ends of said material occurs and thereby insure a firm connection of said sealed opposed portions and severed ends thereof due to such release of said tension on said film material.

2. The machine according to claim 1 further including means operable to return said higher guide bar to the higher operative position thereof after re-connection of the severed ends of said film material has been effected and thereby restore said reconstituted film material to said tensioned condition thereof.

3. A machine for encircling coiled rolls of sheet material with heat-sealable film material provided in supply rolls, said machine comrising in combination, an elongated frame having at one end receiving means to introduce tightly coiled rolls of sheet material as delivered from a re-winding machine and unrestrained from uncoiling and discharge means at the opposite end of said frame; means in said frame defining a path for said coiled rolls including first conveyor means operable at one end to receive and move said coiled rolls along said path in spaced relationship and in a manner to maintain them tightly coiled, means on said frame to support a plurality of supply rolls of heat-sealable film material with the outer ends thereof fused together to provide a continuous film thereof; support and guide means mounted on said frame to position a portion of said continuous film of material transversely to said path, means to move said coiled rolls sequentially against said transverse portion of said film material and thereby partially extend the same around each roll; a narrow support member extending transversely to said path of said coiled rolls and positioned to receive said rolls from said first conveyor means, pusher means operable cyclically to push the leading coiled roll on said first conveyor onto said support membr, heat-sealing means comprising parallel anvil and heater bars extending transversely to said path of said coiled rolls adjacent the forward end of said support member, means operable to move at least one of said bars toward the other to clamp said portion of said heat-sealable film material which extends partially around said coiled rolls into abutting engagement to encircle said coiled roll while supported upon said support member, said heater bar being operable when abutting said anvil bar to simultaneously seal said film material in encircling manner around each roll and also sever the encircling portion from said transverse portion of said material and reconnect the severed portions by fusion to reconstitute said transverse portion thereof; and a second conveyor extending to one end from said support member toward said discharge means of said machine, support means for said one end of said second conveyor mounted for limited vertical movement, said second conveyor comprising a pair of belts spaced transversely to the path of said coiled rolls and said support member being interrupted adjacent the receiving end of said second conveyor belts, means operable to move said one end of said belts of said second conveyor from a position slightly below the level of said support member to a position above said level and thereby engage said coiled rolls after the same have been encircled with said film material to cause said conveyor to move said coiled rolls sequentially from said support member toward the discharge end of said machine to clear said support member to receive the next successive coiled roll, and means operable to move said one end of said belts of said second conveyor in timed sequence with the completion of said sealing and severing of said film material.

4. The machine according to claim 3 in which said machine further includes a pivoted frame adjacent the receiving end of said second conveyor, an idler roll supported by said pivoted frame and around which the belts of said second conveyor extend, and said means operable to move said pivoted frame and idler roll thereon between upper and lower positions thereof respectively disposing said receiving end of said belts of said second conveyor above the level of said support member and below the level thereof comprising fluid-operated cylinder means connected to said pivoted frame and operable to move the same as aforesaid in timed relationship with the completion of the sealing of said film material around each coiled roll of sheet material while disposed stationarily momentarily upon said stationary support member.

5. The machine according to claim 4 further including elongated means positioned parallel to and above the belts of said second conveyor and engagable by said coiled rolls of material to effect rotation thereof in a direction to prevent uncoiling of said rolls of material as the same move to the discharge end of said machine.

6. The machine according to claim 5 in which said heat-sealable film material adapted to be sealed around said coiled rolls of material also is of a heat-shrinkable nature, and said machine further including elongated heater means extending along and parallel to the belts of said second conveyor and in line with portions of said heat-shrinkable film material and operable to shrink the same into close contiguous engagement with the coiled rolls of material to prevent uncoiling of the material thereon.

7. The machine according to claim 5 in which a web of heat-sealable material adapted to encircle and be sealed around said coiled rolls of material also is of a heat-shrinkable nature and is of a width which extends beyond the ends of said rolls of material, and said machine further including elongated heater means extending along and parallel to the belts of said second conveyor and substantially in line with the opposite ends of said rolls, whereby said heater means are operable to shrink the ends of said web which extend beyond the ends of said rolls of material into constricting configurations of smaller diameter than said rolls to prevent uncoiling of said ends of said encircling web axially inward beyond the ends of said coiled rolls of material.

* * * * *